US012281826B2

(12) United States Patent
Izadi-Zamanabadi et al.

(10) Patent No.: US 12,281,826 B2
(45) Date of Patent: Apr. 22, 2025

(54) METHOD FOR MONITORING A REFRIGERANT CHARGE IN A VAPOUR COMPRESSION SYSTEM

(71) Applicant: Danfoss A/S, Nordborg (DE)

(72) Inventors: Roozbeh Izadi-Zamanabadi, Nordborg (DK); Glenn Andreasen, Nordborg (DK); Peter Reichwald, Nordborg (DK)

(73) Assignee: DANFOSS A/S, Nordborg (DK)

( * ) Notice: Subject to any disclaimer, the term of this patent is extended or adjusted under 35 U.S.C. 154(b) by 203 days.

(21) Appl. No.: 17/920,947

(22) PCT Filed: Apr. 22, 2021

(86) PCT No.: PCT/EP2021/060484
§ 371 (c)(1),
(2) Date: Oct. 24, 2022

(87) PCT Pub. No.: WO2021/219474
PCT Pub. Date: Nov. 4, 2021

(65) Prior Publication Data

US 2023/0168012 A1 Jun. 1, 2023

(30) Foreign Application Priority Data

Apr. 28, 2020 (EP) ..... 20171712

(51) Int. Cl.
*F25B 45/00* (2006.01)
*F25B 49/02* (2006.01)

(52) U.S. Cl.
CPC ..... *F25B 45/00* (2013.01); *F25B 49/02* (2013.01); *F25B 2500/222* (2013.01);
(Continued)

(58) Field of Classification Search
CPC .... F25B 45/00; F25B 49/02; F25B 2500/222; F25B 2500/24; F25B 2500/23;
(Continued)

(56) References Cited

U.S. PATENT DOCUMENTS 7,891,201 B1 2/2011 Bush et al.
2006/0021362 A1 2/2006 Sadegh et al.
(Continued)

FOREIGN PATENT DOCUMENTS

CN 1455186 A 11/2003
CN 101512255 A 8/2009
(Continued)

OTHER PUBLICATIONS

Escudier, M., & Atkins, T. (2019). monitor. In A Dictionary of Mechanical Engineering. : Oxford University Press. Retrieved Dec. 18, 2024, from https://www.oxfordreference.com/view/10.1093/acref/9780198832102.001.0001/acref-9780198832102-e-4035. (Year: 2019).*

(Continued)

*Primary Examiner* — Miguel A Diaz
(74) *Attorney, Agent, or Firm* — McCormick, Paulding & Huber PLLC

(57) ABSTRACT

A method for monitoring a refrigerant charge in a vapour compression system (1) is disclosed, the vapour compression system (1) including a compressor unit (2), a heat rejecting heat exchanger (3), a high pressure expansion device (4), a receiver (5), at least one expansion device (9, 10), and at least one evaporator (11, 12) arranged in a refrigerant path. A change in net mass flow into or out of the receiver (5) and/or a change in net enthalpy flow into or out of the receiver (5) is detected, and a pressure inside the receiver (5) is monitored as a function of time, following the detected change in net mass flow and/or in net enthalpy flow.

(Continued)

A time constant being representative for dynamics of the receiver (5) is derived, based on the monitored pressure as a function of time, and information regarding a refrigerant charge in the vapour compression system (1) is derived, based on the derived time constant.

17 Claims, 4 Drawing Sheets

(52) U.S. Cl.
CPC ..... *F25B 2500/24* (2013.01); *F25B 2700/13* (2013.01); *F25B 2700/19* (2013.01)

(58) Field of Classification Search
CPC ..... F25B 2700/13; F25B 2700/19; F25B 2345/00; F25B 2345/001; F25B 2345/002; F25B 2345/003; F25B 2345/006
See application file for complete search history.

(56) References Cited

U.S. PATENT DOCUMENTS

| | | | | |
|---|---|---|---|---|
| 2010/0132399 | A1 | 6/2010 | Mitra et al. | |
| 2010/0300129 | A1 | 12/2010 | Bean, Jr. et al. | |
| 2011/0100040 | A1* | 5/2011 | Bush | F25B 1/10 62/149 |
| 2017/0115043 | A1* | 4/2017 | Laughman | F25B 49/02 |
| 2017/0219263 | A1 | 8/2017 | Schmidt et al. | |
| 2019/0299132 | A1 | 10/2019 | Prins et al. | |

FOREIGN PATENT DOCUMENTS

| | | | |
|---|---|---|---|
| CN | 204063699 | U | 12/2014 |
| CN | 107339835 | A | 11/2017 |
| CN | 109983286 | A | 7/2019 |
| WO | 2008/039204 | A1 | 4/2008 |
| WO | 2008/130358 | A1 | 10/2008 |

OTHER PUBLICATIONS

Written Opinion corresponding to International Application No. PCT/EP2021/060484, dated Jun. 23, 2021.
International Search Report mailed on Jun. 23, 2021, in connection with corresponding International Application No. PCT/EP2021/060484; 3 pages.

* cited by examiner

METHOD FOR MONITORING A REFRIGERANT CHARGE IN A VAPOUR COMPRESSION SYSTEM

CROSS-REFERENCE TO RELATED APPLICATIONS

This application is a National Stage application of International Patent Application No. PCT/EP2021/060484, filed on Apr. 22, 2021, which claims priority to European Patent Application No. 20171712.1, filed on Apr. 28, 2020, each of which is hereby incorporated by reference in its entirety.

TECHNICAL FIELD

The present invention relates to a method for monitoring a refrigerant charge in a vapour compression system. The method according to the invention allows a loss in refrigerant charge to be detected promptly without requiring dedicated sensors therefore.

BACKGROUND

In vapour compression systems, such as refrigeration systems, refrigerant circulates a refrigerant path while being alternatingly compressed by one or more compressors and expanded by one or more expansion devices, and while undergoing heat exchange in at least one heat rejecting heat exchanger and at least one evaporator, respectively. The amount of refrigerant circulating in the refrigerant path is sometimes referred to as a refrigerant charge Over time, refrigerant may leak from the refrigerant path, thereby reducing the refrigerant charge. If the refrigerant charge in a vapour compression system decreases below a certain level, there will no longer be sufficient refrigerant in the refrigerant path to ensure proper operation of the vapour compression system. For instance, a low charge may cause the vapour compression system to operate inefficiently and/or it may not be possible to maintain a sufficiently low temperature in refrigerated volumes, such as display cases, in the case that the vapour compression system is a refrigeration system. This may lead to the vapour compression system being incapable of providing required cooling in at least part of the system, such as in one or more refrigerated compartments, and this may continue until maintenance staff arrives and replenishes the refrigerant charge. In order to avoid this, the refrigerant charge may be monitored in order to allow replenishing of the refrigerant charge before a critical limit is reached.

The refrigerant charge may, e.g., be monitored by means of a dedicated liquid level sensor positioned in a receiver which is arranged in the refrigerant path between an outlet of the heat rejecting heat exchanger and an inlet of the expansion device. This adds components to the vapour compression system, which increases the manufacturing costs as well as maintenance costs, since such a liquid level sensor will also need to undergo normal maintenance. Furthermore, it may be difficult to monitor changes in refrigerant charge over time by means of such a liquid level sensor, and readings from such a sensor may be unreliable, e.g. due to turbulence in the receiver. Finally, there is a risk that a decrease in refrigerant charge is detected too late, in the sense that the vapour compression system might be incapable of providing required cooling, as described above.

As an alternative, service inspection may be planned at regular intervals in order to allow maintenance personnel to control the refrigerant charge. However, in the case that the leaking rate from the vapour compression system is higher than expected, the refrigerant charge may reach a critical level at a time which is between two planned service inspections. This would result in inefficient operation of the vapour compression system, possibly leading the system being incapable of fulfilling cooling requirements, as described above.

SUMMARY

It is an object of embodiments of the invention to provide a method for monitoring a refrigerant charge in a vapour compression system in which a decrease in refrigerant charge can be detected fast and reliably, without increasing manufacturing or maintenance costs.

The invention provides a method for monitoring a refrigerant charge in a vapour compression system, the vapour compression system comprising a compressor unit comprising one or more compressors, a heat rejecting heat exchanger, a high pressure expansion device, a receiver, at least one expansion device, and at least one evaporator arranged in a refrigerant path, each expansion device supplying refrigerant to one of the evaporator(s), the method comprising the steps of:

- detecting a change in net mass flow into or out of the receiver and/or detecting a net enthalpy flow into or out of the receiver,
- monitoring a pressure inside the receiver as a function of time, following the detected change in net mass flow and/or in net enthalpy flow,
- deriving a time constant being representative for dynamics of the receiver, based on the monitored pressure as a function of time, and
- deriving information regarding a refrigerant charge in the vapour compression system based on the derived time constant.

Thus, the method according to the invention is a method for monitoring a refrigerant charge in a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

Accordingly, the vapour compression system comprises a compressor unit comprising one or more compressors, a heat rejecting heat exchanger, a high pressure expansion device, a receiver, at least one expansion device, and at least one evaporator arranged in a refrigerant path. The expansion device(s) may, e.g., be in the form of expansion valves, and each expansion device supplies refrigerant to one of the evaporators. Refrigerant circulates the refrigerant path, and as described above, this refrigerant is in the present context referred to as the refrigerant charge.

Thus, during operation of the vapour compression system, refrigerant circulating the refrigerant path is compressed by means of the compressors of the compressor unit before being supplied to the heat rejecting heat exchanger. When passing through the heat rejecting heat exchanger, heat exchange takes place between the refrigerant and the ambient or a secondary fluid flow across the heat rejecting heat exchanger, in such a manner that heat is rejected from the refrigerant. The heat rejecting heat exchanger may be a condenser, in which case the gaseous part of the refrigerant is at least partly condensed when passing through the heat rejecting heat exchanger. As an alternative, the heat rejecting heat exchanger may be a gas cooler, in which case the refrigerant passing through the heat rejecting heat exchanger is cooled, but remains in a gaseous or trans-critical state.

The refrigerant leaving the heat rejecting heat exchanger passes through the high pressure expansion device, where it undergoes expansion before being supplied to the receiver. The high pressure expansion device may be in the form of a high pressure valve, in the form of an ejector, or in the form of a high pressure valve and an ejector arranged fluidly in parallel.

In the receiver, the liquid part of the refrigerant is separated from the gaseous part of the refrigerant. The gaseous part of the refrigerant may be supplied to the compressor unit. The liquid part of the refrigerant is supplied to the expansion device(s), where it undergoes expansion before being supplied to the respective evaporator(s). In the evaporator(s), the liquid part of the refrigerant is at least partly evaporated, while heat exchange takes place between the refrigerant and the ambient or a secondary fluid flow across the evaporator(s), in such a manner that heat is absorbed by the refrigerant.

Finally, the refrigerant is once again supplied to the compressor unit.

In the method according to the invention, a change in net mass flow into or out of the receiver and/or a change in net enthalpy flow into or out of the receiver is initially detected. As described above, refrigerant enters the receiver via the high pressure expansion device, and leaves the receiver, either via a liquid outlet leading towards the expansion device(s), or via a gaseous outlet leading towards the compressor unit. In the case that the inflow of refrigerant to the receiver differs from the outflow of refrigerant from the receiver, then there is net flow into or out of the receiver.

The net flow could, e.g., be in terms of a net mass flow. In this case the mass of the refrigerant flowing into and out of the receiver is considered. Alternatively or additionally, the net flow could be in terms of a net enthalpy flow. In this case the enthalpy, and thereby energy, of the refrigerant flowing into and out of the receiver, is considered.

A change in net mass flow and/or in net enthalpy flow into or out of the receiver indicates that a change in the operation and/or operating conditions of the vapour compression system is taking place. This will be described further below.

Next, following the detected change in net mass flow and/or in net enthalpy flow, a pressure inside the receiver is monitored as a function of time. Thereby, it is monitored how the temporal behaviour of the pressure inside the receiver is affected by the change in operation and/or operating conditions of the vapour compression system which gave rise to the detected change in net mass flow and/or change in net enthalpy flow into or out of the receiver.

Next, a time constant being representative for dynamics of the receiver is derived, based on the monitored pressure as a function of time. As described above, since the pressure inside the receiver is monitored as a function of time, the measurement data obtained thereby contains information regarding the temporal behaviour of the pressure inside the receiver, in response to the detected change in net mass flow and/or in net enthalpy flow into or out of the receiver. Thereby it also contains information regarding the dynamics of the receiver, in the sense that it contains information regarding how the pressure inside the receiver reacts to a given change in mass flow and/or a given change in enthalpy flow, as a function of time.

The time constant may, e.g., be derived using a mass and/or energy balance of the receiver, such as a linearized mass and/or energy balance of the receiver.

Finally, information regarding a refrigerant charge in the vapour compression system is derived, based on the derived time constant.

In vapour compression systems comprising a receiver, unused refrigerant is stored in the receiver. Information regarding the refrigerant charge can therefore be derived from information relating to the receiver. More particularly, by analysing data relating to the dynamics of the receiver, a relationship between the dynamics of the receiver and the charge in the receiver can be identified. Since the charge in the receiver corresponds to an 'unused' part of the total refrigerant charge in the vapour compression system, there is a relationship between the charge in the receiver and the total charge, and thereby it is also possible to derive information regarding the total charge in the vapour compression system.

Thus, the method according to the invention allows information regarding the charge in the vapour compression system to be obtained fast and reliably, and based on measured parameters which are already available for other purposes. Accordingly, a dedicated sensor is not required, and the manufacturing costs and maintenance costs can thereby be maintained at a low level. Furthermore, the refrigerant charge can be monitored continuously, e.g. online, and thereby an unexpected decrease in the refrigerant charge can be detected early, thereby allowing replenishing of the refrigerant charge, and possibly stopping a leak, well before the refrigerant charge reaches a critical level.

The method according to the invention could, e.g., be performed as a cloud service. In this case, the method could, e.g., be performed by a service provider being granted access to the vapour compression system from a remote position, via a cloud server.

The step of deriving information regarding a refrigerant charge may comprise estimating the refrigerant charge in the vapour compression system. According to this embodiment, the actual or absolute refrigerant charge is derived from the time constant. Thereby it can directly be determined whether or not the refrigerant charge is approaching a critical limit.

Alternatively or additionally, the step of deriving information regarding the refrigerant charge may comprise determining whether or not the refrigerant charge is decreasing, and possibly the rate of change of the refrigerant charge. This will provide an indication regarding whether or not there is a risk that the refrigerant charge will approach a critical limit within the near future. For instance, if the refrigerant charge has been decreasing for a long period of time and/or if the refrigerant is decreasing with a higher rate than expected, then it can be concluded that there is a risk that the refrigerant charge may be approaching the critical limit, e.g. due to a leak in the system, even without knowing the absolute refrigerant charge.

The method may further comprise the step of causing a change in net mass flow into or out of the receiver and/or a change in net enthalpy into or out of the receiver.

According to this embodiment, the change in net mass flow and/or in net enthalpy flow into or out of the receiver which initiates the method and forms the basis of the monitoring of the pressure inside the receiver, is actively created, with the purpose of allowing the dynamical behaviour of the receiver to be analysed, in the manner described above. Thereby information regarding the refrigerant charge can be derived at any chosen time, and as often as desired, and it is not necessary to await a coincidental occurrence of a change in net mass flow and/or in net enthalpy flow. Accordingly, the refrigerant charge can be monitored closely, and a fast reaction can be initiated if it is revealed that the refrigerant charge is decreasing in an undesired or unexpected manner.

The step of causing a change in net mass flow into or out of the receiver and/or a change in net enthalpy flow into or out of the receiver may comprise changing a temperature and/or a pressure of refrigerant supplied to and/or leaving the receiver. A change in the temperature and/or pressure of refrigerant flowing into or out of the receiver will cause a change in the net enthalpy flow into or out of the receiver. The temperature and/or pressure of the refrigerant flowing into or out of the receiver may, e.g., be changed by changing a secondary fluid flow across the heat rejecting heat exchanger, e.g. by changing a speed of a fan or a pumping capacity of a pump driving the secondary fluid flow across the heat rejecting heat exchanger.

As an alternative, the step of causing a change in net mass flow into or out of the receiver and/or a change in net enthalpy flow into or out of the receiver may comprise increasing or decreasing a flow of gaseous refrigerant leaving the receiver. This would change the mass flow of refrigerant out of the receiver, thereby changing the net mass flow into or out of the receiver. The flow of gaseous refrigerant leaving the receiver could, e.g., be increased or decreased by manipulating a connection between a gaseous outlet of the receiver and the compressor unit. For instance, an opening degree of a bypass valve interconnecting a gaseous outlet of the receiver and a part of the refrigerant path which interconnects the outlet(s) of the evaporator(s) and the compressor unit, may be adjusted. Alternatively, in the case that the gaseous outlet of the receiver is connected to one or more dedicated receiver compressors, the flow of gaseous refrigerant leaving the receiver may be increased or decreased by increasing or decreasing the capacity of the receiver compressor(s). For instance, the receiver compressor(s) may be started or stopped. It should be noted that, in the present context, a dedicated receiver compressor may be a compressor which can only be connected to the gaseous outlet of the receiver, or it may be a compressor which can be selectively switched between being connected to the gaseous outlet of the receiver or to the outlet(s) of the evaporator(s).

In any event, the change in net mass flow and/or in net enthalpy flow into or out of the receiver should preferably be an abrupt change, e.g. in the form of a step input, in order to properly activate the dynamics of the receiver.

The method may further comprise the step of repeating the steps of detecting a change in net mass flow into or out of the receiver and/or detecting a change in net enthalpy flow into or out of the receiver, monitoring a pressure inside the receiver and deriving a time constant, and the step of deriving information regarding a refrigerant charge in the vapour compression system may be performed on the basis of a series of derived time constants.

According to this embodiment, a time constant being representative for dynamics of the receiver is derived at least twice, and preferably several times, across a period of time. Thereby a series of derived time constants, obtained sequentially during the period of time, is obtained. The series of derived time constants thereby contains information regarding how the dynamics of the receiver develop over time, and thereby information regarding how the refrigerant charge of the vapour compression system develops over time. Thus, by deriving the information regarding the refrigerant charge from the series of derived time constants, such time dependent information regarding the refrigerant charge is obtained. Thereby it can be immediately, or almost immediately, detected if the refrigerant charge starts decreasing in an unexpected or undesired manner.

The method may further comprise the step of obtaining a measure for an initial amount of refrigerant in the receiver, and the step of deriving information regarding a refrigerant charge in the vapour compression system may comprise deriving an absolute estimate for a charge level in the receiver, based on the derived time constant and on the initial amount of refrigerant in the receiver.

According to this embodiment, the actual and absolute refrigerant charge in the vapour compression system, at the time where the method is performed, is derived. To this end, the initial amount of refrigerant in the receiver, which is an indication of the initial refrigerant charge, is applied. The initial amount of refrigerant in the receiver may, e.g., be measured by maintenance personnel performing replenishing of the refrigerant charge.

BRIEF DESCRIPTION OF THE DRAWINGS

The invention will now be described in further detail with reference to the accompanying drawings in which.

DETAILED DESCRIPTION

Figure 1:
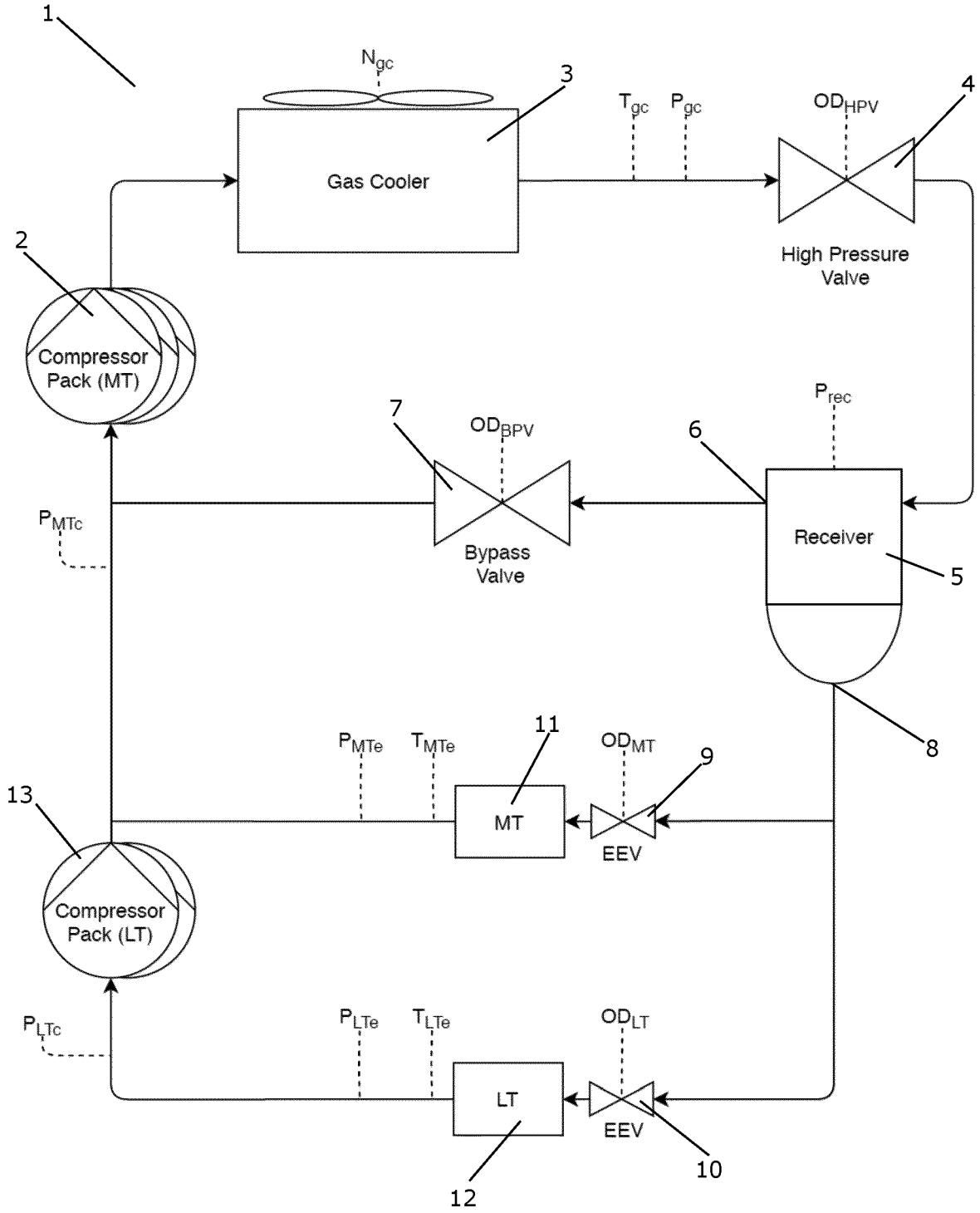
FIG. 1 is a diagrammatic view of a vapour compression system for performing a method according to an embodiment of the invention.

FIG. 1 is a diagrammatic view of a vapour compression system 1 for performing a method according to an embodiment of the invention. The vapour compression system 1 comprises a compressor unit 2 comprising a number of compressors, two of which are shown, a heat rejecting heat exchanger 3, a high pressure valve 4, and a receiver 5. A gaseous outlet 6 of the receiver 5 is connected to the compressor unit 2 via a bypass valve 7. A liquid outlet 8 of the receiver 5 is connected a medium temperature expansion device 9 and to a low temperature expansion device 10. The medium temperature expansion device 9 supplies refrigerant to a medium temperature evaporator 11, and the low temperature expansion device 10 supplies refrigerant to a low temperature evaporator 12. The medium temperature evaporator 11 may, e.g., be arranged in thermal contact with a cooled volume in which a medium temperature is required, e.g. a cooling display case in a supermarket, which should normally be maintained at a temperature of approximately 5° C. The low temperature evaporator 12 may be arranged in thermal contact with a cooled volume in which a low temperature is required, e.g. a freezer display case in a supermarket, which should normally be maintained at a temperature of approximately −18° C. Accordingly, the evaporating temperature at the low temperature evaporator 12 is lower than the evaporating temperature at the medium temperature evaporator 11, and therefore the pressure of the refrigerant passing through the low temperature evaporator 12 is also lower than the pressure of the refrigerant passing through the medium temperature evaporator 11.

The medium temperature evaporator 11 is connected directly to the compressor unit 2. However, the low temperature evaporator 12 is connected to a low temperature compressor unit 13, where the pressure of the refrigerant leaving the low temperature evaporator 12 can be increased before it is mixed with the refrigerant leaving the medium temperature evaporator 11.

When performing the method according to an embodiment of the invention by means of the vapour compression system 1 of FIG. 1, a change in net mass flow into or out of the receiver 5 and/or a change in net enthalpy flow into or out of the receiver 5 is initially detected. The change in net mass flow and/or in net enthalpy flow may, e.g., be caused actively and deliberately, e.g. by opening or closing the bypass valve 7, by changing an opening degree of the high pressure valve 4, by adjusting a secondary fluid flow across the heat rejecting heat exchanger 3, e.g. by manipulating a fan or a pump driving such a secondary fluid flow, and/or in any other suitable manner which changes a mass flow and/or an enthalpy flow into or out of the receiver 5.

Following the detected change in net mass flow and/or in net enthalpy flow into or out of the receiver 5, a pressure inside the receiver 5 is monitored as a function of time. Thereby measurement data is obtained, which provides information regarding how the pressure inside the receiver 5 changes over time, in response to the detected change in net mass flow and/or in net enthalpy flow.

The obtained measurement data is then analysed in order to derive a time constant being representative for dynamics of the receiver 5. Finally, information regarding a refrigerant charge in the vapour compression system 1 is derived, based on the derived time constant. This is possible because unused refrigerant is stored in the receiver 5, and dynamics of the receiver 5 are therefore representative for the refrigerant charge in the vapour compression system 1.

The time constant being representative for dynamics of the receiver 5 may, e.g., be derived in the following manner.

A mass balance for the receiver 5 may be identified, assuming that gas and liquid in the receiver 5 are saturated, that the liquid in the receiver 5 is furthermore assumed to be incompressible, and that changes in density of the refrigerant before the high pressure valve 4 and after the bypass valve 7 are negligible. The change in refrigerant mass in the receiver 5 depends on the difference between mass flow into the receiver 5 and mass flow out of the receiver 5, i.e.:

$$\begin{aligned}\frac{dM_{rec}}{dt} &= \dot{m}_{HPV} - \dot{m}_{BPV} - \dot{m}_{MTe} - \dot{m}_{LTe} \\ &= f(OD_{HPV})\sqrt{2\rho_{gc}(P_{gc} - P_{rec})} - \\ &\quad f(OD_{BPV})\sqrt{2\rho_{MTc}(P_{rec} - P_{MT})} - \\ &\quad \dot{m}_{MTe} - \dot{m}_{LTe},\end{aligned}$$

where $\dot{m}_{HPV}$ is the mass flow through the high pressure valve 4, $\dot{m}_{BPV}$ is the mass flow through the bypass valve 7, $\dot{m}_{MTe}$ is the mass flow towards the medium temperature evaporator 11, $\dot{m}_{LTe}$ is the mass flow towards the low temperature evaporator 12, p is the density of the refrigerant, P designates pressure of the refrigerant, and f(OD) is a function including valve characteristics of the respective valves 4, 7.

Furthermore:

$$\frac{dM_{rec}}{dt} =$$

-continued $$\frac{d(\rho_l V_l + \rho_g V_g)}{dt} = \left(V_l \frac{d\rho_l}{dP_{rec}} + (V_t - V_l)\frac{d\rho_g}{dP_{rec}}\right)\frac{dP_{rec}}{dt} + (\rho_l - \rho_g)\frac{dV_l}{dt},$$

where $V_l$ is the volume of liquid refrigerant in the receiver 5, $V_g$ is the volume of gaseous refrigerant in the receiver 5, and $V_t$ is the total volume of refrigerant in the receiver 5, i.e. $V_t = V_l + V_g$.

Furthermore, an energy balance for the receiver 5 is calculated as:

$$\frac{dU_{rec}}{dt} = \dot{m}_{HPV} h_{HPV} - \dot{m}_{BPV} h_{BPV} - \dot{m}_{MTe} h_{MTe} - \dot{m}_{LTe} h_{LTe},$$

where h designates enthalpy. In other words, the change in internal energy of the receiver 5 is a function of energy entering the receiver 5 via the high pressure valve 4, and energy leaving the receiver 5 via the bypass valve 7 and the evaporators 11, 12, respectively.

Furthermore:

$$\frac{dU_{rec}}{dt} = \frac{d(U_l + U_g)}{dt} = \left(V_l \rho_l \frac{dh_l}{dP_{rec}} + (V_t - V_l)\rho_g \frac{dh_g}{dP_{rec}} + V_l h_l \frac{d\rho_l}{dP_{rec}} + (V_t - V_l) h_g \frac{d\rho_g}{dP_{rec}} - V_t\right) \frac{dP_{rec}}{dt} + (\rho_l h_l - \rho_g h_g)\frac{dV_l}{dt}.$$

From the two equations above, $$\frac{dV_l}{dt}$$

can be isolated and substituted into the equation regarding the mass balance, and the resulting combined mass balance and energy balance can be linearized. A time constant, $\tau_c$, being representative for dynamics of the receiver 5 can then be derived from the linearized mass and energy balance, and the liquid volume of refrigerant in the receiver 5 can be estimated from the derived time constant, $\tau_c$.

As an alternative, the time constant may be derived based on non-linear approach, e.g. applying higher order models or estimation methods.

Figure 2:
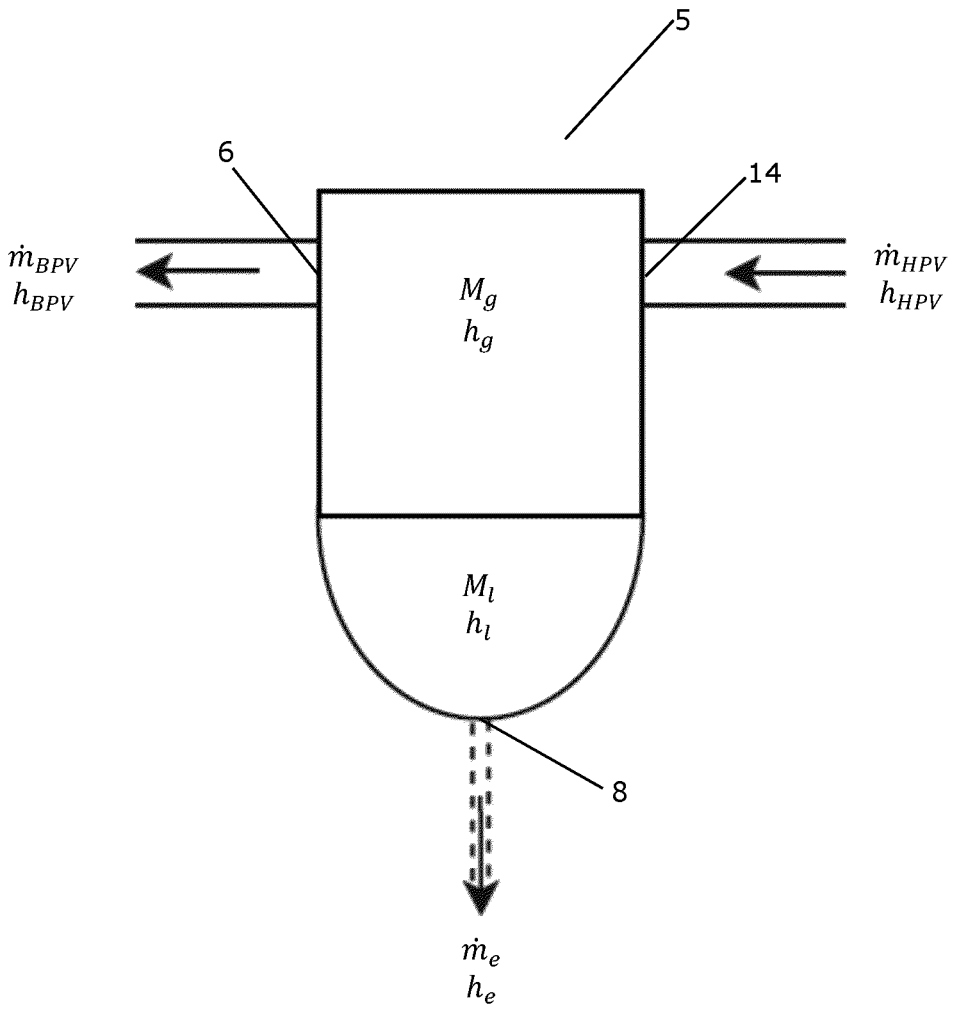
FIG. 2 illustrates mass flow and enthalpy flow into and out of a receiver of a vapour compression system.

FIG. 2 illustrates mass flow and enthalpy flow into and out of a receiver 5 of a vapour compression system. The vapour compression system could, e.g., be the vapour compression system of FIG. 1. It can be seen that mass flow, $\dot{m}_{HPV}$, and enthalpy flow, $h_{HPV}$ coming from a high pressure valve, enter the receiver via an inlet 14. It can further be seen that mass flow, $\dot{m}_{BPV}$, and enthalpy flow, $h_{BPV}$, leave the receiver 5 via a gaseous outlet 6, and flow towards a bypass valve and further on towards a compressor unit. Finally, it can be seen that mass flow, $\dot{m}_e$, and enthalpy flow, $h_e$, leave the receiver 5 via a liquid outlet 8, and flow towards expansion devices and further on towards evaporators.

The mass flows and enthalpy flows to and from the receiver 5 result in balances inside the receiver 5 with respect to gaseous mass, $M_g$, gaseous enthalpy, $h_g$, liquid mass, $M_l$, and liquid enthalpy, $h_l$. The balances may, e.g., be calculated in the manner described above with reference to FIG. 1.

Figure 3:
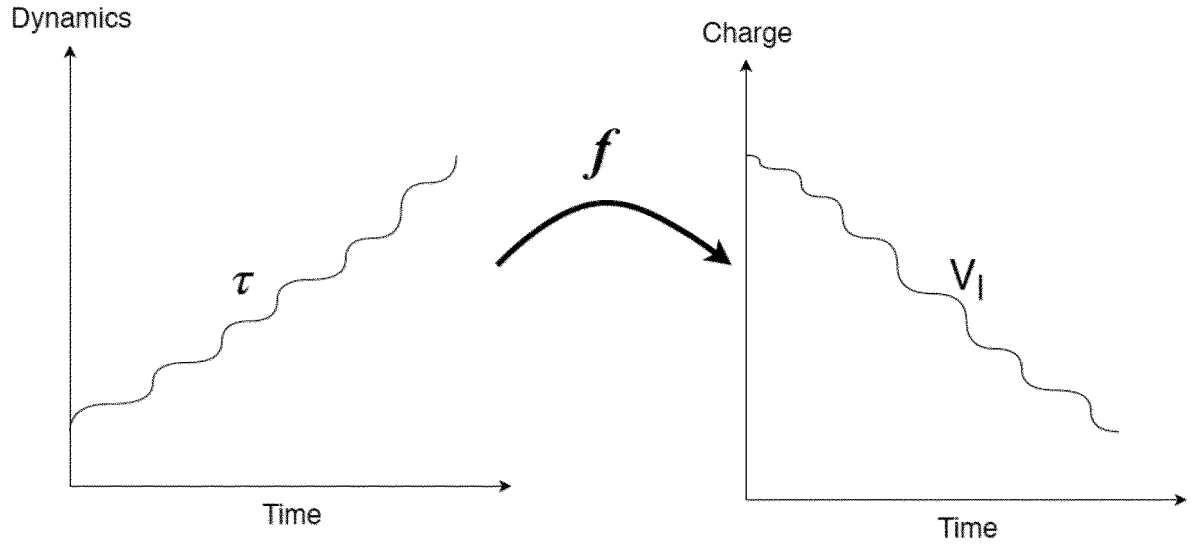
FIG. 3 illustrates deriving of information regarding a refrigerant charge based on a time constant being representative for dynamics in a receiver, in accordance with a method according to an embodiment of the invention.

FIG. 3 illustrates deriving of information regarding a refrigerant charge based on a time constant being representative for dynamics in a receiver, in accordance with a method according to an embodiment of the invention.

The left graph illustrates dynamics of a receiver as a function of time, following a change in net mass flow and/or enthalpy flow into or out of the receiver. It can be seen that the dynamics are generally changing as a function of time, and this takes place in 'steps' at substantially regular time intervals. These time intervals define a time constant, t, which is representative for the dynamics of the receiver.

A function, f, defines a relationship between the dynamics of the receivers, notably the time constant, $\tau$, and the liquid refrigerant charge, $V_l$, in the receiver. Thereby, based on the derived time constant, $\tau$, and the function, f, an estimate for the liquid refrigerant charge, $V_l$, can be derived, as illustrated in the right graph, which shows the estimated charge as a function of time. Since the liquid refrigerant charge in the receiver is closely related to the total refrigerant charge in the vapour compression system, as described above, an estimate for the total refrigerant charge can also be derived.

Figure 4:
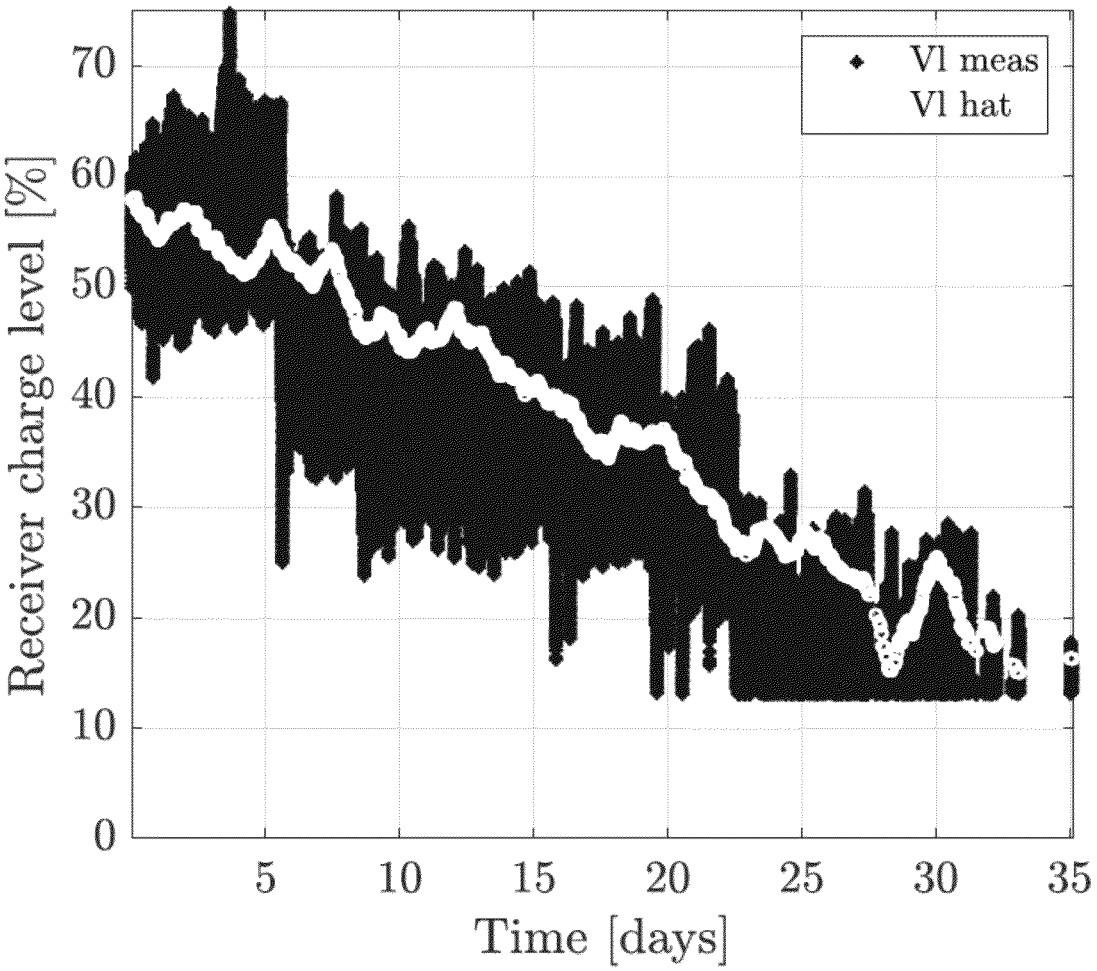
FIG. 4 is a graph illustrating refrigerant charge as a function of time, as a result of performing a method according to an embodiment of the invention.

FIG. 4 is a graph illustrating refrigerant charge in a receiver as a function of time. The graph of FIG. 4 is based on data obtained during a test, and the graph includes measurement data obtained by means of a liquid level sensor arranged in the receiver, Vl meas in black, and estimated refrigerant charge derived by means of a method according to an embodiment of the invention, Vl hat in white. It can be seen that the estimated refrigerant charge, Vl hat, closely follows the measured liquid level, Vl meas. Accordingly, it can be concluded that the method according to the invention provides an accurate estimate for the refrigerant charge in the receiver.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A method for monitoring a refrigerant charge in a vapour compression system the vapour compression system comprising a compressor unit comprising one or more compressors, a heat rejecting heat exchanger, a high pressure valve, a receiver, at least one expansion device, and at least one evaporator arranged in a refrigerant path, each expansion device supplying refrigerant to one of the evaporator(s), the method comprising the steps of:

detecting a change in net mass flow into or out of the receiver and/or detecting a change in net enthalpy flow into or out of the receiver, measuring a pressure inside the receiver as a function of time to thereby obtain measurement data of temporal behavior of the pressure inside the receiver, following the detected change in net mass flow and/or in net enthalpy flow, deriving a time constant being representative for dynamics of the receiver, based on the measured pressure as a function of time, and deriving information regarding a refrigerant charge in the vapour compression system based on the derived time constant.

2. The method according to claim 1, wherein the step of deriving information regarding the refrigerant charge comprises estimating the refrigerant charge in the vapour compression system.

3. The method according to claim 1, further comprising the step of causing a change in net mass flow into or out of the receiver and/or a change in net enthalpy flow into or out of the receiver.

4. The method according to claim 3, wherein the step of causing the change in net mass flow into or out of the receiver and/or the change in net enthalpy flow into or out of the receiver comprises changing a temperature and/or a pressure of refrigerant supplied to and/or leaving the receiver.

5. The method according to claim 3, wherein the step of causing the change in net mass flow into or out of the receiver and/or the change in net enthalpy flow into or out of the receiver comprises increasing or decreasing a flow of gaseous refrigerant leaving the receiver.

6. The method according to claim 1, further comprising the step of repeating the steps of detecting the change in net mass flow into or out of the receiver and/or detecting the change in net enthalpy flow into or out of the receiver, measuring the pressure inside the receiver and deriving the time constant, and wherein the step of deriving information regarding the refrigerant charge in the vapour compression system is performed on the basis of a series of derived time constants.

7. The method according to claim 1, further comprising the step of obtaining a measure for an initial amount of refrigerant in the receiver, and wherein the step of deriving information regarding the refrigerant charge in the vapour compression system comprises deriving an absolute estimate for a charge level in the receiver, based on the derived time constant and on the initial amount of refrigerant in the receiver.

8. The method according to claim 2, further comprising the step of causing a change in net mass flow into or out of the receiver and/or a change in net enthalpy flow into or out of the receiver.

9. The method according to claim 2, further comprising the step of repeating the steps of detecting the change in net mass flow into or out of the receiver and/or detecting the change in net enthalpy flow into or out of the receiver, measuring the pressure inside the receiver and deriving the time constant, and wherein the step of deriving information regarding the refrigerant charge in the vapour compression system is performed on the basis of a series of derived time constants.

10. The method according to claim 3, further comprising the step of repeating the steps of detecting the change in net mass flow into or out of the receiver and/or detecting the change in net enthalpy flow into or out of the receiver, measuring the pressure inside the receiver and deriving the time constant, and wherein the step of deriving information regarding the refrigerant charge in the vapour compression system is performed on the basis of a series of derived time constants.

11. The method according to claim 4, further comprising the step of repeating the steps of detecting the change in net mass flow into or out of the receiver and/or detecting the change in net enthalpy flow into or out of the receiver, measuring the pressure inside the receiver and deriving the time constant, and wherein the step of deriving information regarding the refrigerant charge in the vapour compression system is performed on the basis of a series of derived time constants.

12. The method according to claim 5, further comprising the step of repeating the steps of detecting the change in net mass flow into or out of the receiver and/or detecting the change in net enthalpy flow into or out of the receiver, measuring the pressure inside the receiver and deriving the time constant, and wherein the step of deriving information regarding the refrigerant charge in the vapour compression system is performed on the basis of a series of derived time constants.

13. The method according to claim 2, further comprising the step of obtaining a measure for an initial amount of refrigerant in the receiver, and wherein the step of deriving information regarding the refrigerant charge in the vapour compression system comprises deriving an absolute estimate for a charge level in the receiver, based on the derived time constant and on the initial amount of refrigerant in the receiver.

14. The method according to claim 3, further comprising the step of obtaining a measure for an initial amount of refrigerant in the receiver, and wherein the step of deriving information regarding the refrigerant charge in the vapour compression system comprises deriving an absolute estimate for a charge level in the receiver, based on the derived time constant and on the initial amount of refrigerant in the receiver.

15. The method according to claim 4, further comprising the step of obtaining a measure for an initial amount of refrigerant in the receiver, and wherein the step of deriving information regarding the refrigerant charge in the vapour compression system comprises deriving an absolute estimate for a charge level in the receiver, based on the derived time constant and on the initial amount of refrigerant in the receiver.

16. The method according to claim 5, further comprising the step of obtaining a measure for an initial amount of refrigerant in the receiver, and wherein the step of deriving information regarding the refrigerant charge in the vapour compression system comprises deriving an absolute estimate for a charge level in the receiver, based on the derived time constant and on the initial amount of refrigerant in the receiver.

17. The method according to claim 6, further comprising the step of obtaining a measure for an initial amount of refrigerant in the receiver, and wherein the step of deriving information regarding the refrigerant charge in the vapour compression system comprises deriving an absolute estimate for a charge level in the receiver, based on the derived time constant and on the initial amount of refrigerant in the receiver.

* * * * *